US006576338B1

(12) United States Patent
Meijer et al.

(10) Patent No.: US 6,576,338 B1
(45) Date of Patent: Jun. 10, 2003

(54) YARN AND METHOD FOR MANUFACTURING A YARN CONTAINING SUPER ABSORBENT FIBERS

(75) Inventors: Johannes Adrianus Geradus Maria Meijer, Helmond (NL); Ludovicus Bernardus Wilhelmus Maria Van Kimmenade, 'S-Hertogenbosch (NL)

(73) Assignee: Vepetex B.V., Beurne (NL)

( * ) Notice: Subject to any disclaimer, the term of this patent is extended or adjusted under 35 U.S.C. 154(b) by 0 days.

(21) Appl. No.: 10/031,541

(22) PCT Filed: Jul. 17, 2000

(86) PCT No.: PCT/NL00/00501

§ 371 (c)(1),
(2), (4) Date: May 24, 2002

(87) PCT Pub. No.: WO01/06047

PCT Pub. Date: Jan. 25, 2001

(30) Foreign Application Priority Data

Jul. 21, 1999 (NL) ..... 1012661

(51) Int. Cl.[7] ..... D01F 6/00

(52) U.S. Cl. ..... 428/357; 428/362; 428/372; 428/370

(58) Field of Search ..... 428/357, 362, 428/372, 370

(56) References Cited

U.S. PATENT DOCUMENTS 5,249,248 A 9/1993 Arroyo et al. ..... 385/113

FOREIGN PATENT DOCUMENTS

| | | |
|---|---|---|
| EP | 0342370 | 11/1989 |
| GB | 712683 | 7/1954 |
| GB | 896855 | 5/1962 |
| WO | 9404728 | 3/1994 |

*Primary Examiner*—N. Edwards
(74) *Attorney, Agent, or Firm*—Webb Ziesenheim Logsdon Orkin & Hanson, P.C.

(57) ABSTRACT

A method for manufacturing a yarn containing superabsorbent fibers of polyacrylate, wherein said superabsorbent fibers are blended with supporting fibers of a material stronger than that of the superabsorbent fibers so as to form a sliver from a blend of said fibers. The sliver is spun into a yarn by using an open end spinning method, wherein the fibers of the sliver are individualized. Subsequently the fibers are fed in an air flow to a rotating spinning space, from where the yarn is spun.

8 Claims, 1 Drawing Sheet

YARN AND METHOD FOR MANUFACTURING A YARN CONTAINING SUPER ABSORBENT FIBERS

BACKGROUND OF THE INVENTION

1) Field of the Invention

The invention relates to a method for manufacturing a yarn containing superabsorbent fibres of polyacrylate. Superabsorbent fibres of this kind are capable of absorbing many times their own weight of water. The invention relates in particular to the manufacture of yarns which are capable of absorbing more than 25 times their own weight of water.

2) Description of the Prior Art

Superabsorbent fibres of polyacrylate are highly vulnerable, so that a relatively low mechanical load leads to damage or breakage of the fibres. Consequently, these yarns are unsuitable for being processed into a yarn, unless they are first blended with supporting fibres of a stronger material. The supporting fibres protect the superabsorbent fibres against damage and breakage during the manufacture of the yarn, and in the finished yarn they give the yarn its cohesion and strength. The supporting fibres are for example made of polyester, polypropylene, nylon, cotton, viscose, etc.

U.S. Pat. No. 5,249,248 discloses yarns of this kind and states that a blend of such fibres consisting of at least 30% polyester supporting fibres exhibits handling characteristics that correspond to those of polyester fibres.

It is usual to manufacture these yarns by feeding both the superabsorbent fibres and the supporting fibres separately to a blender, in which the two fibres are blended in swirling air, after which the fibres are formed into a sliver. In order to prevent damage or breakage of the superabsorbent fibres, the carding treatment is adapted to take place only at reduced power, that is, more slowly, whereby the blending fibres are loaded to a smaller extent.

In the sliver the vulnerable superabsorbent fibres are surrounded by the stronger supporting fibres, as a result of which they are protected against mechanical loads. This makes it possible to treat the sliver in a usual manner, for example store it temporarily and feed it to a spinning machine for being processed into a yarn in the usual manner.

In the spinning machine the sliver is stretched, that is, drawn out to a greater length, so that the fibres will extend substantially in the longitudinal direction of the sliver, after which the sliver is twisted or provided with a fixation thread wound therearound.

A longer fibre is conducive to the adhesion and strength both of the sliver and of the yarn, and it is usual for the fibres that are processed into a yarn to have a length of more than 40 mm, preferably more than 50 mm.

The object of the invention is to provide a method for manufacturing a yarn containing superabsorbent fibres of polyacrylate, wherein relatively short superabsorbent fibres are present. Preferably, relatively large interspaces are present between the superabsorbent fibres.

SUMMARY OF THE INVENTION

According to the invention, in order to accomplish that objective, the method referred to in the introduction for manufacturing a yarn containing superabsorbent fibres of polyacrylate, wherein said superabsorbent fibres are blended with supporting fibres of a material stronger than that of the superabsorbent fibres so as to form a sliver from a blend of said fibres, which sliver is spun into a yarn, employs the open end spinning method, wherein the fibres of the sliver are individualized by being subjected to a mechanical load, after which the fibres are individually fed in an air flow to a rotating spinning space, from where the yarn is spun.

Although it seems illogical to individualize the vulnerable superabsorbent fibres from the sliver so that they are damaged or broken, it has become apparent that the presence of the shorter superabsorbent fibres has advantages for certain uses of the yarn. This is true in particular with regard to medical applications, wherein the presence of large interspaces between the fibres causes the yarn to swell less when absorbing a certain amount of liquid. The presence of larger interspaces results from the less well-ordered arrangement of the fibres. The superabsorbent fibres, which are damaged or broken during individualization, are arranged in the yarn in a less well-ordered fashion after spinning.

The open end spinning method, wherein the fibres are subjected to a relatively heavy mechanical load, is a spinning method which is known per se. The yarn is thereby twisted in that the yarns are pulled out of a quickly rotating spinning space through an opening located near the axis of rotation. The yarn is thereby composed of fibres which are present in the spinning space and which have been fed to the spinning space individually, that is, without any mutual cohesion, so that each fibre can follow the rotation of the spinning space individually.

Preferably, the blend of fibres from which the sliver is made contains more than 30%, preferably more than 40% and more preferably more than 50% of superabsorbent fibres, in order to obtain a high absorptive capacity.

In one preferred embodiment the fibres of the sliver are individualized by means of a rotating carding device, which pulls the fibres from the sliver under an substantial mechanical load, during which process at least part of the superabsorbent fibres break.

The invention furthermore relates to a yarn containing superabsorbent fibres of polyacrylate and stronger supporting fibres of another material, wherein the polyacrylate fibres are on average shorter than the supporting fibres of another material. The average length of the fibres is thereby preferably less than 80%, preferably less than 65%, of the length of the supporting fibres of said other, stronger material.

Preferably, the superabsorbent fibre originally has a length of about 51 mm, and after being spun into a yarn said length is on average shorter than the original length, preferably less than 80%, more preferably less than 65 of the original length.

BRIEF DESCRIPTION OF THE DRAWINGS

In order to explain the invention more fully, the method for manufacturing a yarn will be explained in more detail hereafter with reference to a schematic representation in the drawing.

DETAILED DESCRIPTION OF THE INVENTION

Figure 1:
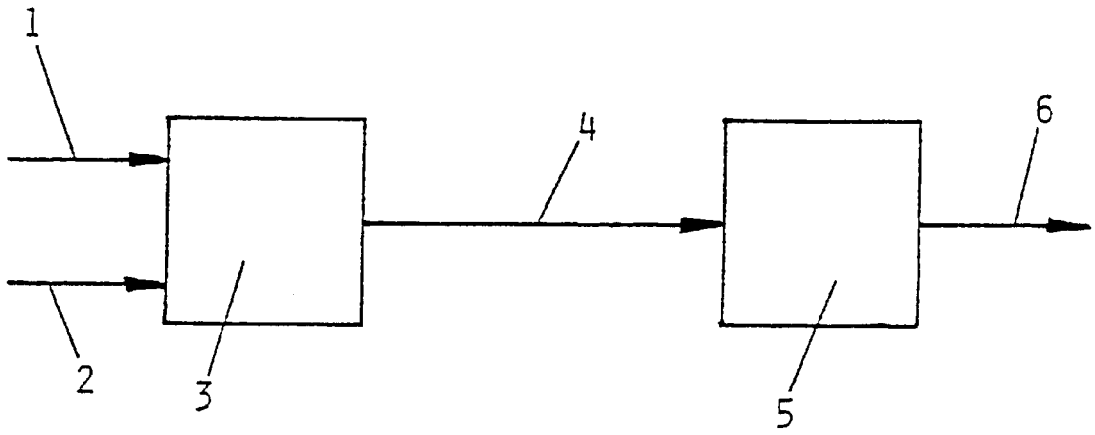
FIG. 1 schematically shows the conventional method of manufacturing the yarn containing schematically show fibres.

According to FIG. 1, superabsorbent fibres 1 of polyacrylate and supporting fibres 2 of a stronger material are fed to a blending chamber 3. The fibres 1, 2 being fed can be loosened from a stock in a usual manner, after which blending in the blending chamber 3 can take place in a swirling air flow. Said loosening of the superabsorbent fibres 1 and said blending must be carried out with due care in order to prevent the vulnerable superabsorbent fibres 1 being damaged or broken.

Then the blended fibres 1, 2 are formed into a sliver 4 in a usual manner. In the sliver 4 the vulnerable superabsorbent fibres 1 are surrounded by stronger supporting fibres 2, which protect them against damage and breakage. Subsequently, sliver 4 is fed to a spinning machine 5, possibly after having been stored first, in which spinning machine the sliver 4 is stretched and twisted into a yarn 6.

Figure 2:
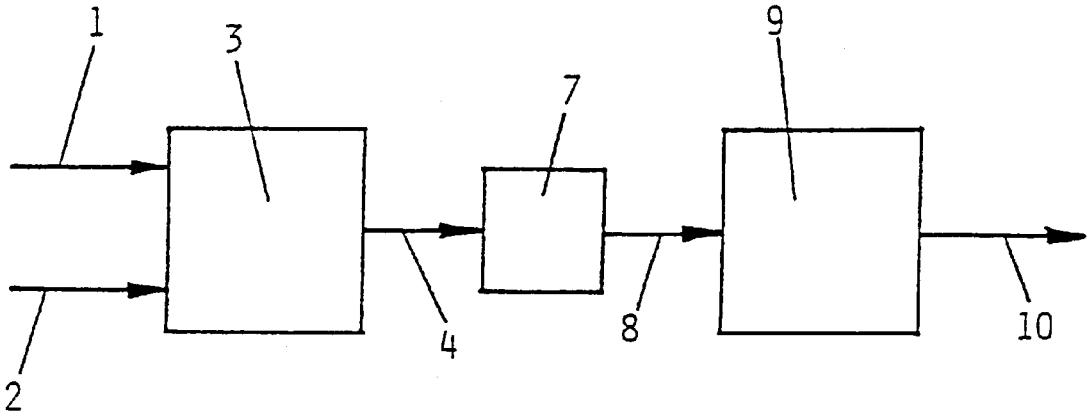
FIG. 2 schematically shows the method according to the invention.

According to FIG. 2 superabsorbent fibres 1 and supporting fibres 2 are likewise fed to a mixing chamber 3 and formed into a sliver 4. Sliver 4 is then fed to a device 7, which individualizes the fibres of sliver 4 by mechanically drawing them out of sliver 4 by means of a rotating carding device.

Following that, the individualized fibres are fed to the rotating spinning space 9 of an open end spinning machine in an air flow (indicated at 8), whereupon they exit the machine in the form of a spun (twisted) yarn 10.

During the individualization of the fibres damage and breakage of the vulnerable superabsorbent fibres takes place as intended, and the supporting fibres remain intact, so that the yarn 10 that is subsequently spun exhibits sufficient strength and cohesion.

What is claimed is:

1. A method for manufacturing a yarn containing superabsorbent fibres of polyacrylate, wherein said superabsorbent fibres are blended with supporting fibres of a material stronger than that of the superabsorbent fibres so as to form a sliver from a blend of said fibres, which sliver is spun into a yarn, wherein an open end spinning method is used, and wherein the fibres of the sliver are individualized and subsequently fed in an air flow to a rotating spinning space, from where the yarn is spun.

2. The method according to claim 1, wherein said blend contains more than 30% of superabsorbent fibres.

3. The method according to claim 1, wherein said blend contains more than 40% of superabsorbent fibres.

4. The method according to claim 1, wherein said blend contains more than 50% of superabsorbent fibres.

5. The method according to claim 1, wherein the fibres of the sliver are individualized by means of a rotating carding device.

6. A yarn containing superabsorbent fibres of polyacrylate and supporting fibres of a stronger material, wherein the polyacrylate fibres are on average shorter than the supporting fibres.

7. The yarn according to claim 6, wherein the length of the fibres of polyacrylate is on average less than 80% of the length of the supporting fibres.

8. The yarn according to claim 6, wherein the length of the fibres of polyacrylate is on average less than 65% of the length of the supporting fibres.

* * * * *